US005164557A

United States Patent [19]

Allison

[11] Patent Number: 5,164,557

[45] Date of Patent: Nov. 17, 1992

[54] LAMP SWITCH AND CONNECTOR MEANS ASSEMBLY

[75] Inventor: Johnny H. Allison, Redford, Mich.

[73] Assignee: Ford Motor Company, Dearborn, Mich.

[21] Appl. No.: 692,751

[22] Filed: Apr. 29, 1991

[51] Int. Cl.[5] ..... H01H 3/16; F21V 23/04

[52] U.S. Cl. ..... 200/61.62; 200/61.76; 362/80; 362/155

[58] Field of Search ..... 200/51.13, 51.14, 51.16, 200/61.62, 61.76, 61.81, 61.82, 530, 535; 362/80, 155

[56] References Cited

U.S. PATENT DOCUMENTS

| | | | |
|---|---|---|---|
| 2,418,905 | 4/1947 | Sage | 200/51.13 |
| 2,436,898 | 3/1948 | Rickmeyer | 200/530 |
| 2,646,477 | 7/1953 | Herterick | 200/51.13 |
| 2,658,968 | 10/1953 | Janos | 200/61.62 |
| 2,816,972 | 12/1957 | Haut | 200/61.62 |
| 3,300,755 | 1/1967 | Dunn | 340/457.1 |
| 4,146,762 | 3/1979 | Peck et al. | 200/61.62 |
| 4,160,887 | 7/1979 | van Buren, Jr. | 200/61.62 |
| 4,168,411 | 9/1979 | Peck | 200/61.62 |
| 4,384,181 | 5/1983 | Booden | 200/61.76 |
| 4,554,618 | 11/1985 | Bafunno et al. | 362/155 |
| 4,979,083 | 12/1990 | Takano et al. | 200/61.76 X |

*Primary Examiner*—J. R. Scott

*Attorney, Agent, or Firm*—Charles H. Ellerbrock; Roger L. May

[57] ABSTRACT

A lamp switch and connector means assembly comprising an integral housing which is mountable to the interior of a compartment for illuminating the compartment. The switch is operable by means of a biased plunger, for example, in response to the opening and closing of a compartment lid. Fixed to the plunger is an electrical bridging means which simultaneously and immediately engages stationary, nonbiased electrical contacts when the plunger is biased toward an extended position.

15 Claims, 1 Drawing Sheet

LAMP SWITCH AND CONNECTOR MEANS ASSEMBLY

BACKGROUND OF THE INVENTION

This invention relates generally to closure actuated lamp switches and, more particularly, to a lamp switch and connector means assembly contained within an integral housing preferably suitable for installation in automobile glove boxes.

In automobiles, closure actuated switches are typically installed to control lamps or bulbs which illuminate the interiors of glove boxes or other compartments only when the compartments are open. Generally, closure actuated switches operate by means of a plunger to close and open a circuit. The plunger causes electrical contacts of opposite polarity in the electrical circuit either to engage each other directly or to be bridged in some fashion by a connecting means. Friction between opposing poles of an open circuit occurs generally in such switches when the opposing poles are moved into direct contact with each other or with a bridging means to complete the circuit. When opposing poles are biased, friction between them or a bridging means will be greater. The friction tends to cause wear and tear on the opposing poles which, in turn, often decreases the usable life of the switch. Repeated usage may strain the biased poles beyond their resiliency, thereby impairing the ability of the opposing poles to provide a stable electrical connection.

Known closure actuated switches have utilized plunger-type means to complete an electric circuit to light a lamp or bulb. For example, U.S. Pat. No. 2,646,477 discusses a closure actuated switch wherein a single terminal or tab of metal near the lamp portion of the assembly is connected to the ungrounded portion of an automobile battery. The grounding terminal is located at the plunger portion of the assembly and grounds the circuit through a metal frame located within the glove box. Accordingly, the terminals are located at opposite ends of the assembly. The switch completes an electrical circuit through movement of a plunger which brings two electrical contacts of opposite polarity into direct contact. A spring biasing means which forces the plunger to an extended position, thereby connecting the two electrical contacts, is part of the electrical circuit as it electrically connects the bulb with one of the electrical contacts.

An electrical switch is discussed in U.S. Pat. No. 4,384,181 wherein a conductive sleeve is positioned on a rod section of a plunger. The conductive sleeve contacts two terminals which are biased toward the conductive sleeve. The conductive sleeve travels a length of the biased terminals when engaging and disengaging them.

A combined illumination and minimum temperature control for refrigerators is discussed in U.S. Pat. No. 2,658,968. The control assembly is composed of a contact ring positioned on a plunger so as to make contact with terminals. The terminals are movable in response to temperature conditions within the refrigerator. A lamp is mounted on the back wall of the refrigerator remote from the control assembly. Also connected to the control assembly is a temperature-sensing unit. The control assembly lights the remote lamp even when the refrigerator door is not open to increase the temperature within the refrigerator.

A drawback of known closure actuated switches is their reliance upon sliding contact between nonstationary opposing poles either directly or through a bridging means to complete a circuit. The poles to be connected are often biased, requiring them to be strained upon making electrical contact. The resulting friction may produce wear and tear upon the poles themselves. Additionally, a problem arises when biased poles are strained by use beyond their resiliency. The poles may not retain enough resiliency to maintain stable electrical contact leading to premature failure of the circuit.

Therefore a need exists to provide a lamp switch and connector assembly which is integral in design, and preferably suitable for installation in automobile glove boxes. It is a particular object of an embodiment of the present invention to provide a closure actuated lamp switch and connector means assembly comprising an integral housing and a plunger-type actuating means. Other objects, features and advantages of the present invention will become apparent from the following description taken in conjunction with the accompanying drawings.

BRIEF SUMMARY OF THE INVENTION

As stated previously, closure actuated switches are typically installed to control lamps or bulbs which illuminate the interiors of glove boxes or other compartments only when the compartments are open. A lamp switch and connector means assembly which is integral in design offers particularly desirable characteristics.

An embodiment of a lamp switch and connector means assembly of the present invention may comprise an integral housing. The embodiment may further comprise an electrical contact means within a lamp socket cavity within the integral housing, connector means for engaging an electrical power source, plunger means movably disposed within a plunger chamber within the integral housing, and electrical bridging means affixed to the plunger means for engaging and electrically connecting spaced electrical contacts within the plunger chamber when the plunger is biased toward an extended position by a biasing means. The plunger means may have a rod section extending axially out of the plunger chamber through a plunger passage and a head section integral with the rod section and extending radially within the plunger chamber.

The embodiment offers advantages in that the lamp switch and connector means assembly is comprised of an integral housing allowing for ease of installation within a glove box or other compartment. The embodiment may also be manufactured easily and economically, while offering a limited number of moving parts thereby reducing the likelihood of mechanical and electrical failure.

BRIEF DESCRIPTION OF THE DRAWINGS

The lamp switch and connector means assembly of the present invention may be more easily understood by referring to FIG. 1 which is an electrical circuit diagram of a preferred embodiment of the lamp switch and connector means assembly of the present invention.

DETAILED DESCRIPTION OF PREFERRED EMBODIMENTS

The principles of the present invention may be applied with particular advantage to provide a lamp switch and connector means assembly comprising an integral housing. The lamp switch and connector means assembly is electrically interconnected as further described below.

Figure 1:
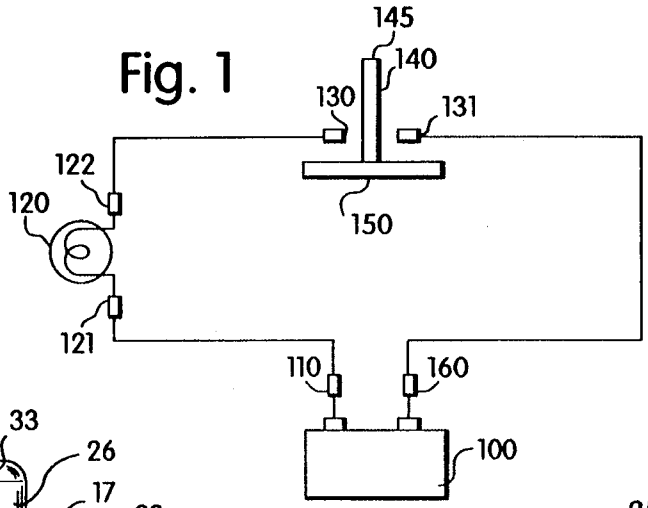
Figure 3:
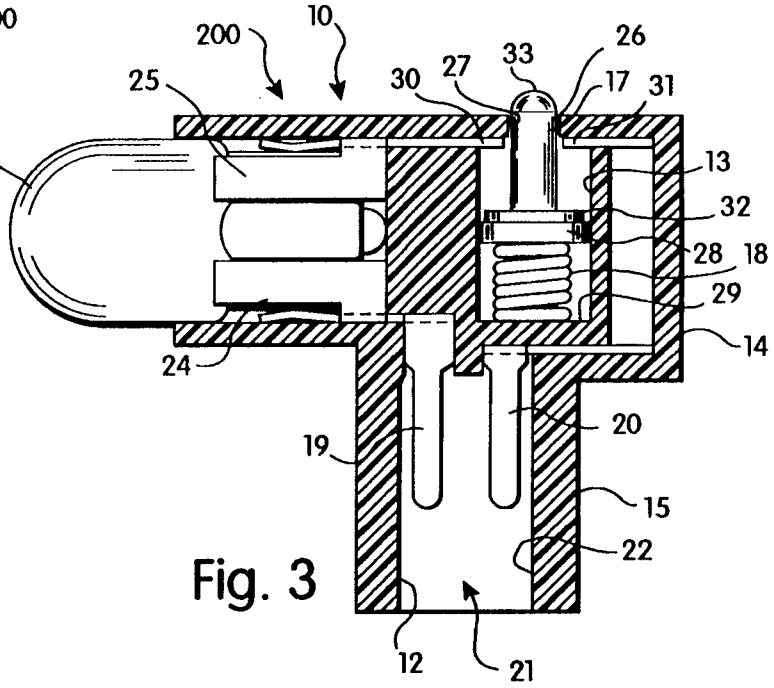
FIG. 3 is a side elevation, partially in cross section, of the lamp switch and connector means assembly of FIG. 1 engaging a bayonetted-type lamp with a plunger being in a retracted position.
Figure 2:
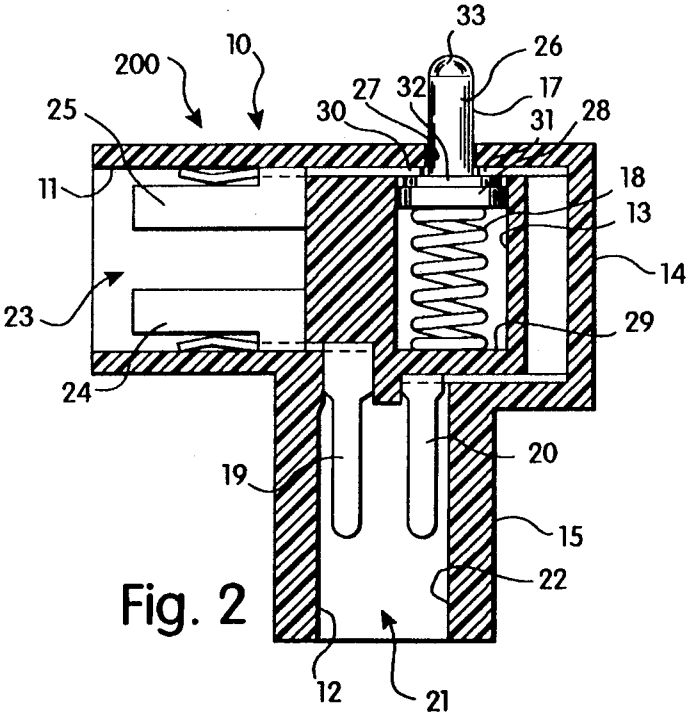
FIG. 2 is a side elevation, partially in cross section, of the lamp switch and connector means assembly of FIG. 1 with a plunger being in an extended position.

FIG. 1 depicts a circuit diagram electrically connecting in series circuit, power source 100, for example an automobile battery, first terminal 110, first lamp contact 121, lamp 120, second lamp contact 122, spaced electrical contacts 130 and 131 of opposite polarity, moveable plunger 140 carrying electrical bridging means 150, and second terminal 160. A connector means for electrically connecting the circuit to the power source comprises first and second terminals 110 and 160. Plunger 140 and electrical bridging means 150 operate as a switch to open and close the circuit. Biasing means 18 as shown in FIGS. 2 and 3 forces plunger 140 and electrical bridging means 150 to an extended position, thereby simultaneously engaging and electrically interconnecting spaced electrical contacts 130 and 131. When plunger 140 is depressed to a retracted position, for example, by pressure of a glove box cover against extended end 145 of plunger 140, electrical bridging means 150 simultaneously disengages and electrically disconnects spaced electrical contacts 130 and 131. Spaced electrical contacts 130 and 131 are preferably nonbiased and stationary to reduce friction and loss of resiliency tending to decrease the life of the switch. More detailed features of a preferred embodiment are described below.

Referring to FIGS. 2 and 3, a lamp switch and connector assembly 200 in accordance with a preferred embodiment of the present invention comprises integral housing member generally indicated at 10 fashioned from electrically insulating material and having socket cavity 11, connector cavity 12 and plunger chamber 13. Integral housing 10 is generally "T" shaped with upper body portion 14 comprising socket cavity 11 and plunger chamber 13, and with lower body portion 15 comprising connector cavity 12. As shown in FIGS. 2 and 3, socket cavity 11 and connector cavity 12 are oriented to receive lamp 16 (shown in FIG. 3), and a power connector (not shown) to opposite poles of a power source, respectively, in a perpendicular fashion. Plunger chamber 13 is oriented such that movement of plunger 17 via biasing means 18 within plunger chamber 13 is perpendicular to the direction of insertion of lamp 16 into socket cavity 11. It is to be understood that the orientation as depicted in FIGS. 2 and 3 of socket cavity 11, connector cavity 12 and plunger chamber 13 within integral housing 10 is a preferred orientation and that depending upon the environment in which the lamp switch and connector means assembly is placed, different orientations can be employed.

As depicted in FIGS. 2 and 3, a preferred embodiment of connector means for accepting a power source in mating fashion includes first terminal 19 and second terminal 20 (corresponding to first terminal 110 and second terminal 160, respectively, of FIG. 1) extending in a parallel fashion within connector cavity 12 with connector cavity 12 extending beyond first and second terminals 19 and 20. In other embodiments, connector means comprising first and second terminals 19 and 20 may extend beyond connector cavity 12 or connector means may extend directly out of integral housing 10 absent connector cavity 12. It is to be understood that each terminal may be either positive or negative depending upon the flow of electricity. Preferably, first and second terminals 19 and 20 are elongated metal tabs which mate with corresponding female electrical connections. Connector cavity 12 has opening 21 and interior side wall 22 which may be contoured to register with an exterior surface of a power source connector to provide a secure mating connection between the connector means and the power source connector. Typical power source connectors include, for example, a standard Yazaki CO2 MW connector. When a connector means, preferably connector cavity 12 and first and second terminals 19 and 20, is engaged by an anchored power source connector, the lamp switch and connector means assembly 200 is securely mountable, for example, within an automobile glove box.

Socket cavity 11 has opening 23 capable of receiving lamp 16. Socket cavity 11 houses electrical contact means for electrically connecting lamp 16. As shown in FIGS. 2 and 3, first lamp contact 24 and second lamp contact 25 (corresponding to first and second lamp contacts 121 and 122, respectively, of FIG. 1) are adapted to engage and secure a bayonetted-type lamp. First and second lamp contacts 24 and 25 and the bayonetted-type lamp can be standard units well known to those skilled in the art. Each lamp contact can be comprised of 2 angled sections which are biased toward one another. Lamp 16 is inserted between the angled sections of each lamp contact thereby engaging lamp 16 in an electrically conductive manner. The biased nature of the angled sections serves to secure lamp 16 within socket cavity 11.

Disposed within plunger chamber 13, is plunger 17 which is axially moveable between an extended position and a retracted position within plunger chamber 13. Plunger 17 comprises rod section 26 extending axially out of plunger chamber 17 through plunger passage 27 and head section 28 integral with rod section 26 and extending radially therefrom within plunger chamber 13. The diameter of head section 28 is greater than the diameter of plunger passage 27, thereby preventing head section 28 from moving through plunger passage 27.

Biasing means 18 is disposed within plunger chamber 13, preferably between head section 28 of plunger 17 and end wall 29 of plunger chamber 13 for biasing plunger 17 toward an extended position as shown in FIG. 2. Preferably, biasing means 18 is a metal coil spring seated against end wall 29.

Also positioned within plunger chamber 13, on opposite sides of plunger passage 27, are spaced electrical contacts 30 and 31 of opposite polarity (corresponding to spaced electrical contacts 130 and 131, respectively, of FIG. 1). Preferably, spaced electrical contacts 30 and 31 are nonbiased stationary flat metal tabs.

Electrical bridging means 32 is affixed to plunger 17, preferably being seated against head section 28 at the base of rod section 26. Electrical bridging means 32 simultaneously engages and electrically interconnects spaced electrical contacts 30 and 31 when plunger 17 is in its extended position and not when plunger 17 is in its retracted position. Preferably, electrical bridging means 32 is an annular metal ring or the like which surrounds rod section 26 of plunger 17 and seats against head section 28 of plunger 17..

FIG. 3 depicts the lamp switch and connector means assembly of FIG. 1, engaging a bayonetted-type lamp 16 with plunger 17 in a retracted position. When plunger 17 is forced against biasing means 18, for example by a glove box cover forcing against end 33 of rod section 26, to a retracted position as depicted in FIG. 3, electrical bridging means 32 simultaneously and immediately separates from spaced electrical contacts 30 and 31.

It is to be understood that the embodiments of the present invention which have been described are merely illustrative of applications of the principles of the present invention. Numerous modifications may be made by those skilled in the art without departing from the true spirit and scope of the invention.

What is claimed is:

1. A lamp switch and connector means assembly comprising:

a T-shaped integral housing having an upper body portion and a lower body portion, said upper body portion having a lamp socket cavity and a plunger chamber therein and said lower body portion having a connector cavity therein;

electrical contact means comprising first and second lamp contacts within said lamp socket cavity for electrically connecting a lamp;

connector means comprising first and second terminals within said connector cavity for engaging an electrical power source;

a plunger means movably disposed within said plunger chamber, said plunger means having a rod section extending axially out of said plunger chamber through a plunger passage and a head section integral with said rod section and extending radially within said plunger chamber, the diameter of said plunger passage preventing said head section from moving through said plunger passage;

spaced electrical contacts of opposite polarity within said plunger chamber on opposite sides of said plunger passage;

electrical bridging means affixed to said plunger means for engaging and electrically connecting said spaced electrical contacts when said plunger is in an extended position; and biasing means disposed within said plunger chamber for biasing said plunger toward said extended position;

a first one of said spaced electrical contacts being in direct electrical contact with said first terminal, a second one of said spaced electrical contacts being in direct electrical contact with said first lamp contact, and said second lamp contact being in direct electrical contact with said second terminal.

2. The assembly of claim 1 wherein said electrical contact means is adapted to engage a bayonette-type lamp.

3. The assembly of claim 1 mounted within an automobile glove box by the engagement of said connector means with said electrical power source.

4. The assembly of claim 1 wherein said spaced electrical contacts are metal tabs positioned on either side of said plunger passage.

5. The assembly of claim 5 wherein said metal tabs are nonbiased and stationary.

6. The assembly of claim 1 wherein said electrical bridging means is an annular metal ring surrounding said rod section of said plunger and seated against said head section of said plunger.

7. The assembly of claim 1 wherein said biasing means is a metal coil spring disposed between said plunger head and an end wall of said plunger chamber.

8. The assembly of claim 1 wherein said integral housing is a unitary plastic housing.

9. A lamp switch and connector means assembly comprising:

a T-shaped integral housing having an upper body portion and a lower body portion, said upper body portion having a lamp socket cavity and a plunger chamber within said upper body portion, and said lower body portion having a connector cavity within said lower body portion;

electrical contact means comprising first and second lamp contacts within said lamp socket cavity for electrically connecting a lamp;

connector means comprising first and second terminals within said connector cavity for engaging an electrical power source;

a plunger means movably disposed within said plunger chamber, said plunger means having a rod section extending axially out of said plunger chamber through a plunger passage and a head section integral with said rod section and extending radially within said plunger chamber, the diameter of said plunger passage preventing said head section from moving through said plunger passage;

spaced electrical contacts of opposite polarity within said plunger chamber on opposite sides of said plunger passage comprising nonbiased stationary metal tabs;

electrical bridging means affixed to said plunger means for engaging and electrically connecting said spaced electrical contacts when said plunger is in an extended position; and biasing means disposed within said plunger chamber for biasing said plunger toward said extended position;

a first one of said spaced electrical contacts being in direct electrical contact with said first terminal, a second one of said spaced electrical contacts being in direct electrical contact with said first lamp contact, and said second lamp contact being in direct electrical contact with said second terminal.

10. The assembly of claim 9 wherein said electrical contact means is adapted to engage a bayonetted-type lamp.

11. The assembly of claim 9 mounted within an automobile glove box by the engagement of said connector means with said electrical power source.

12. The assembly of claim 9 wherein said electrical bridging means is an annular metal ring surrounding the rod section of said plunger and seated against the head section of said plunger.

13. The assembly of claim 9 wherein said integral housing is a unitary plastic housing.

14. The assembly of claim 9 wherein said biasing means is a metal coil spring disposed between said plunger head and an end wall of said plunger chamber.

15. A closure actuated switch and connector assembly comprising:

a plastic T-shaped housing having an upper body portion and a lower body portion, said upper body portion having a lamp socket cavity and a plunger chamber within said upper body portion, and said lower body portion having a connector cavity within said lower body portion;

electrical contact means comprising first and second lamp contacts within said lamp socket cavity for electrically connecting a bayonetted-type lamp;

connector means comprising first and second terminals within said connector cavity for engaging an electrical power source, said housing being mountable by engagement of said connector means with said electrical power source;

a plunger means movably disposed within said plunger chamber, said plunger means having a rod section extending axially out of said plunger chamber through a plunger passage and a head section integral with said rod section and extending radially within said plunger chamber, the diameter of said plunger passage preventing said head section from moving through said plunger passage;

spaced electrical contacts of opposite polarity within said plunger chamber on opposite sides of said plunger passage comprising nonbiased stationary metal tabs;

electrical bridging means affixed to said plunger means for engaging and electrically connecting said spaced electrical contacts when said plunger is in an extended position, said electrical bridging means comprising an annular metal ring surrounding the rod section of said plunger for simultaneously engaging and electrically interconnecting said nonbiased stationary metal tabs when said plunger is in an extended position; and biasing means comprising a metal coil spring disposed between said plunger head and an end wall of said plunger chamber for biasing said plunger toward said extended position wherein said electrical bridging means contacts said spaced electrical contacts;

a first one of said spaced electrical contacts being in direct electrical contact with said first terminal, a second one of said spaced electrical contacts being in direct electrical contact with said first lamp contact, and said second lamp contact being in direct electrical contact with said second terminal.

* * * * *